United States Patent [19]

Stanik

[11] 4,247,032

[45] Jan. 27, 1981

[54] MACHINE FOR THE ATTACHMENT OF RIVETS, BUTTONS OR THE LIKE

[75] Inventor: Raimund Stanik, Wuppertal, Fed. Rep. of Germany

[73] Assignee: Schaeffer-Homberg GmbH, Wuppertal, Fed. Rep. of Germany

[21] Appl. No.: 924,980

[22] Filed: Jul. 17, 1978

[30] Foreign Application Priority Data

Jul. 21, 1977 [DE] Fed. Rep. of Germany ..... 2732931

[51] Int. Cl.[3] ..... A41H 37/10

[52] U.S. Cl. ..... 227/18; 227/32; 227/38; 227/129; 227/134

[58] Field of Search ..... 227/15–18, 227/31, 32, 37, 38, 129, 134, 149; 173/121, 122; 72/452

[56] References Cited

U.S. PATENT DOCUMENTS

| | | | |
|---|---|---|---|
| 826,081 | 7/1906 | Angell | 227/129 |
| 1,182,594 | 5/1916 | Stanley | 227/18 |
| 1,999,057 | 4/1935 | Peterson et al. | 83/628 |
| 2,175,737 | 10/1939 | Berman et al. | 227/18 |
| 2,557,757 | 6/1951 | Paxton et al. | 227/149 |
| 2,936,454 | 5/1960 | Lundeberg | 227/18 |
| 2,949,665 | 8/1960 | Bergsland et al. | 227/149 |
| 3,084,344 | 4/1963 | Schmidt | 227/18 |
| 3,964,661 | 6/1976 | Schmidt et al. | 227/18 |

FOREIGN PATENT DOCUMENTS

| | | | |
|---|---|---|---|
| 945788 | 4/1974 | Canada | 227/149 |
| 2341258 | 2/1975 | Fed. Rep. of Germany . | |

*Primary Examiner*—John McQuade
*Attorney, Agent, or Firm*—Martin A. Farber

[57] ABSTRACT

Machine for attachment of rivets, buttons or the like, particularly to clothing pieces, with an upper tool traveling towards the lower tool, which upper tool sits on a vertically guided upper tool ram. The working stroke of the ram is achieved by means of an inclined surface of a wedge, the latter entering between a roller of the ram and an abutment on the machine side, with the inclined surface of the wedge running on the roller.

9 Claims, 5 Drawing Figures

MACHINE FOR THE ATTACHMENT OF RIVETS, BUTTONS OR THE LIKE

Figure 1:
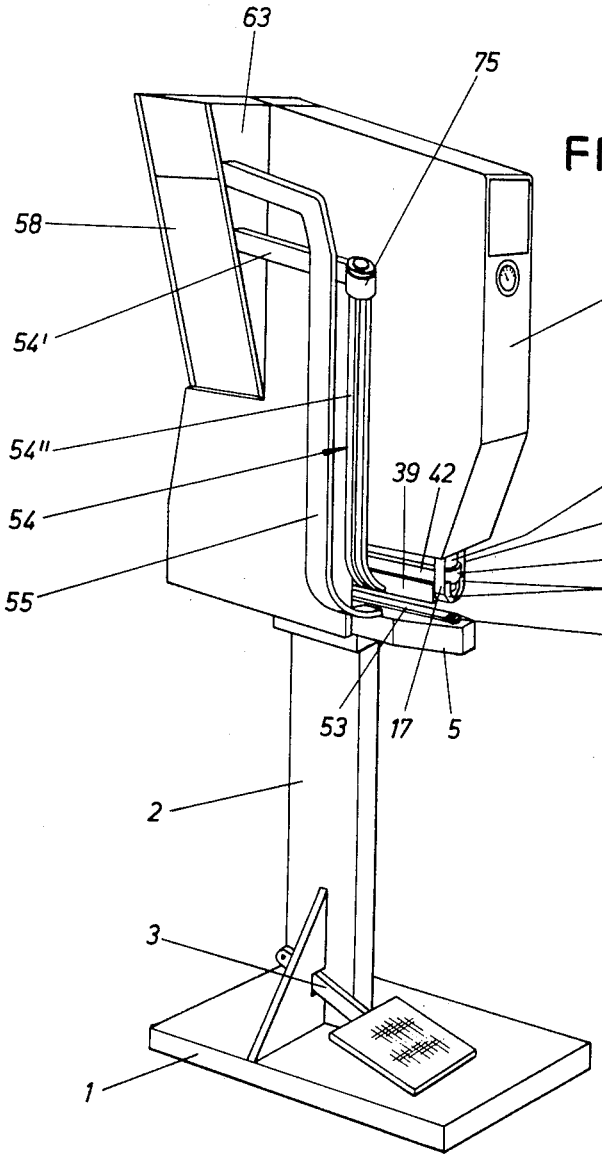

The invention relates to a machine for attachment of rivets, buttons or the like, particularly to clothing pieces, with an upper tool traveling towards the lower tool, which upper tool sits on a vertically guided upper tool ram.

With a known development the upper tool ram obtains its working stroke by a bent lever guide. The drive ram acts on this guide, the ram being controlled by the drive eccentric (German Offenlegungsschrift OS No. 2 341 258). Indeed by this embodiment one obtains a satisfactory working result, however the drive is expensive which leads to higher production costs.

It is an object of the invention to form a machine of the previously set forth type, in a simple manner of production and advantageous use such that a displacement of the upper tool ram is achieved with simple and cost economizing components.

By one feature of the invention this object is solved in that the working stroke of the ram is achieved by means of an inclined surface of a wedge, the latter stepping between a roller and a machine-sided abutment, the inclined surface running on a roller of the ram.

As a result of such development a machine of the introductory type is produced, the drive of which, which drive is coordinated to the upper tool ram, has a very simple construction and can be produced with cost economy. The structural part displacing the ram simply is a wedge, the latter traveling between the roller of the ram and a stationary abutment of the machine and in this manner a controlled or necessary downward movement of the ram occurs. In this manner precisely adjusted working strokes may be obtained. Depending upon the alignment of the inclined surface of the wedge, the ratio between the displacement and force is determinable. For the linear displacement of the wedge, per se proven drive elements can be used. The drive consequently has few parts and is not susceptible to trouble. Possible repairs are easier to perform.

An advantageous feature according to the invention is that the ram is spring-biased in the return travel direction. After the wedge has displaced the ram in the operating direction and the wedge travels back again, the ram also arrives in its starting position by means of the spring-biasing. The engagement between the roller of the ram and the wedge is always maintained.

Moreover it has proven favorable to mount the wedge on the piston rod of a pneumatic cylinder. The force of the ram consequently can easily be varied. Simultaneously with the changing of the pressure inside of the pneumatic cylinder, the pressing force of the ram changes. Preferably for this purpose the machine is to be provided with a pressure meter so that by means of a regulatable component or structural member, the most different operating pressures can be selected. In this manner the range of use of the machine may be considerably increased.

An advantageous further formation is characterized in the manner that the wedge has two inclined surfaces, which connect with each other, of different inclination such that the steeper inclined surface lies in the area of the point of the wedge. The steeper inclination surface serves for the rapid advance of feed of the ram, whereas the flatter aligned inclined surface acts during the pressing operation.

According to the invention it is favorable that the downward movement of the ram is translated into a rearward movement of spring-biased workpiece insertion sliders, the latter being transversely directed relative to the ram originating from the upper and lower tool and with their dependent forward movements which are dependent on spring tension, advance the workpieces into the working position, which workpieces are brought from the magazine via the feed rails. The same drive consequently yet is used to displace the workpiece insertion sliders so that a completely simple and cost economical construction of the drive occurs.

Advantages are brought in the manner by providing a one-sided direction free-floating (releasable) connection between the tool insertion sliders and the connecting rod which transmits the ram movement to these sliders, the latter being equipped with laterally directed actuation fingers. If disturbances should be present, consequently it is possible to displace the tool introduction sliders independently of the connecting rod drive, in order, for example, to remove faulty workpieces.

Moreover beyond that a favorable feature resides in that the clamping fingers, which are carried by the upper tool during the downward stroke, are carried on leaf springs, the latter extending from a slide and which is mounted on the ram, the spring being arranged on both sides of the ram. This also leads to a simplification of the construction of the machine in the area of the drive side.

It has been shown favorable from a driving technique to form the abutment by means of a roller body. The friction values between the inclined surface of the wedge and the abutment in this manner are comparatively small.

Finally a favorable development resides in the ram return spring acting on the transmission connection rod. Consequently this spring fulfills a double function: On the one hand it biases the transmission connecting rod in the direction of the base or normal position and on the other hand it brings the roller of the ram into engagement or abutment with the wedge.

One embodiment example of the invention is illustrated in the drawings and is more closely described in the following.

Figure 2:
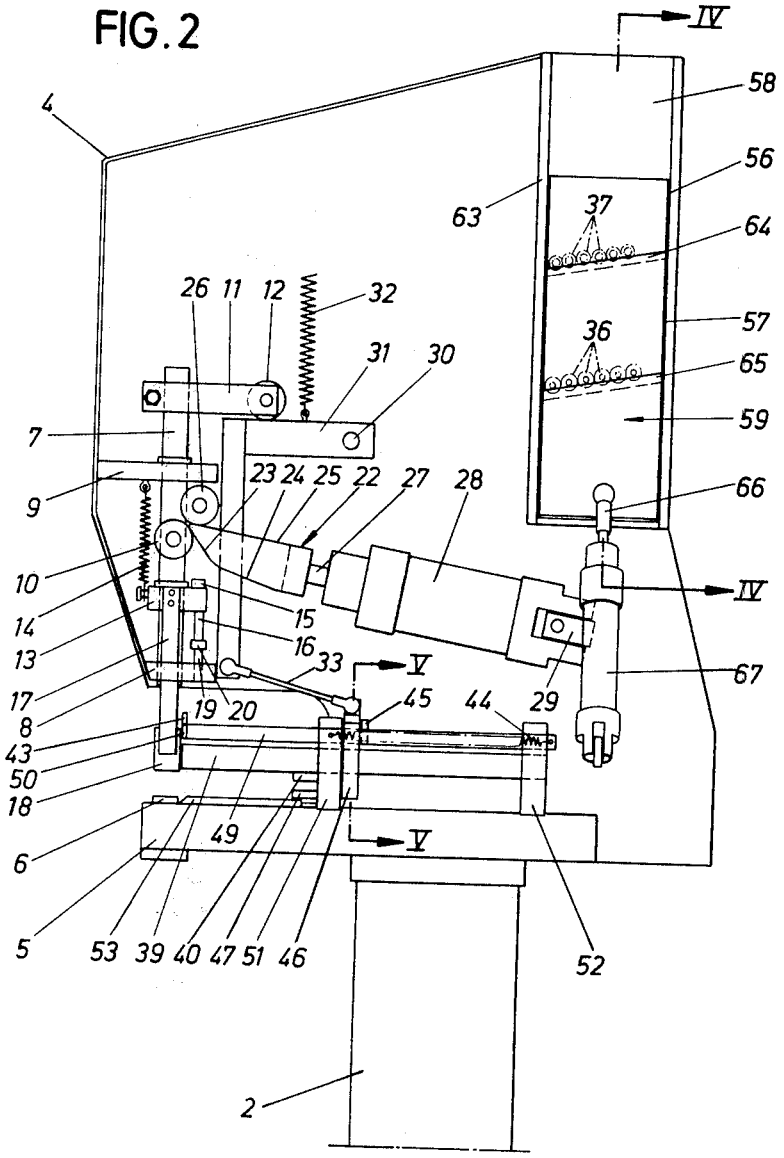
Figure 3:
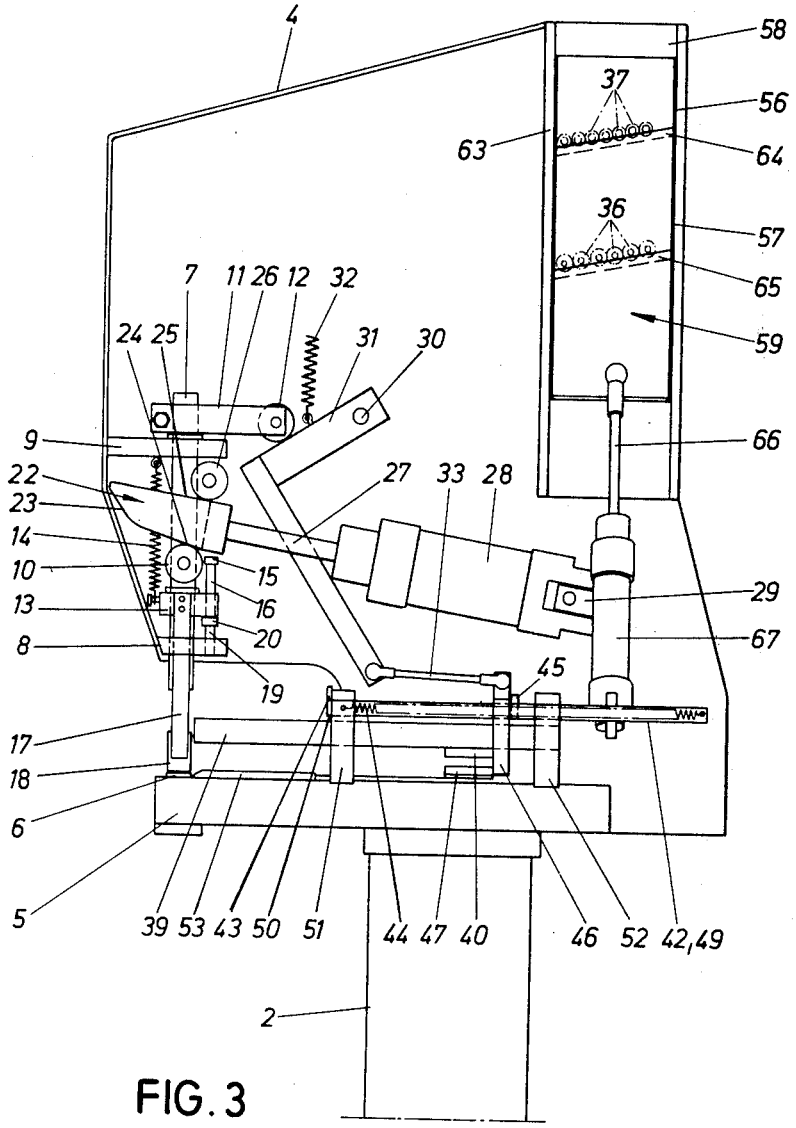
Figure 4:
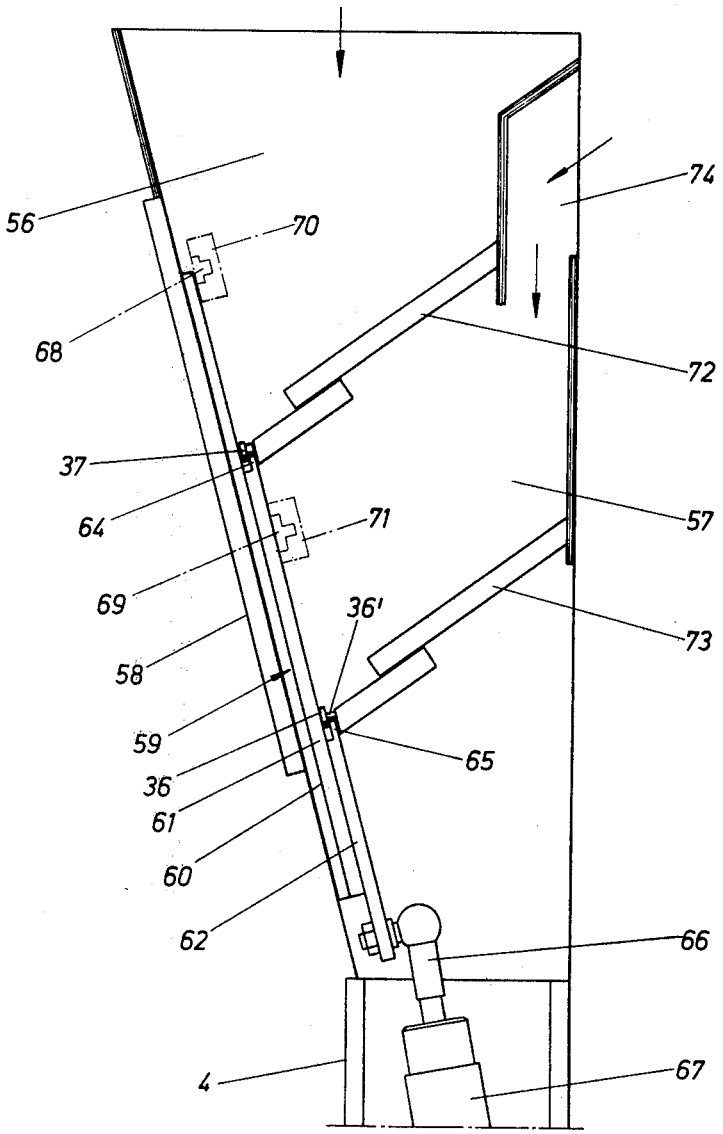
Figure 5:
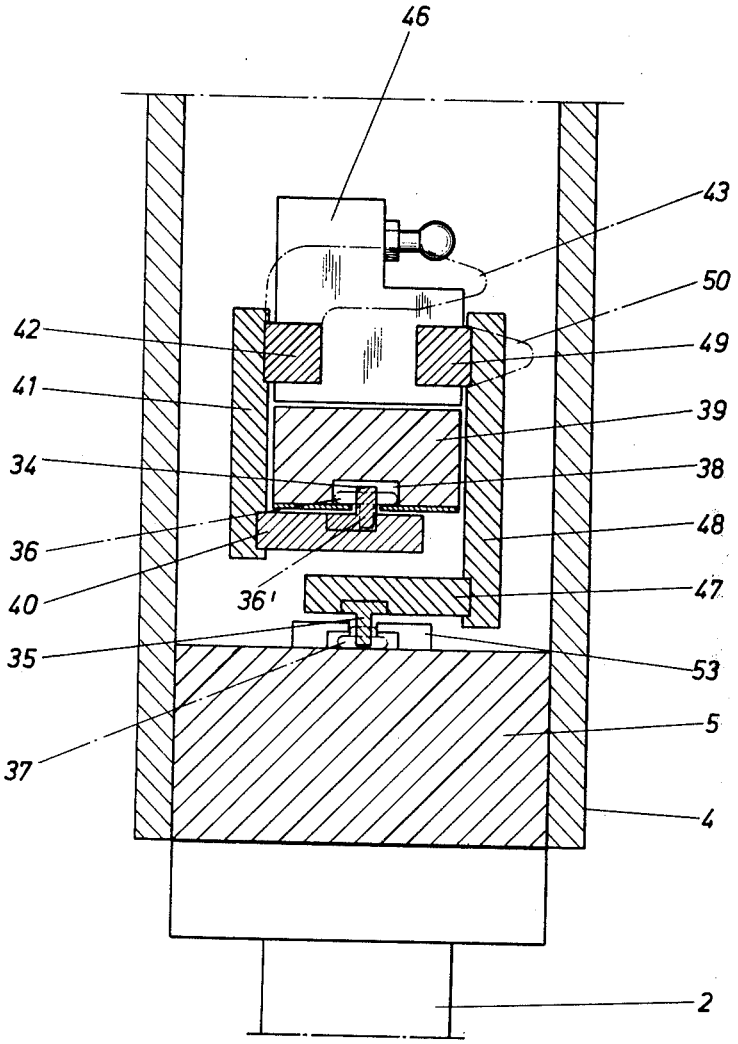

FIG. 1 is a perspective illustration of the machine in accordance with the invention, FIG. 2 is a side view toward the drive of the machine in the base or normal position of the same, FIG. 3 is an illustration corresponding to FIG. 2, whereby the wedge has moved the ram downwardly, FIG. 4 is the section according to the line IV—IV in FIG. 2 and FIG. 5 is the section according to the line V—V in FIG. 2.

FIG. 1 shows a machine which is suited for operation while sitting, i.e., the level of the work is adapted to the existing standards. The machine could also be made such that the working level corresponds to the norm or standard for a standing manner of operation.

In particular the machine has a machine stand or pedestal 2, the latter being carried by the base plate 1. The foot lever 3 is mounted on the machine stand 2. By means of the connection rods (not illustrated), the foot lever starts the working stroke of the machine.

The machine housing 4 is mounted on the stand 2. The machine housing on the lower side contains the projecting arm 5, the latter carrying the lower tool 6 on the front end.

The ram 7 extends flush in alignment with the lower tool 6. The ram 7 is guided in two pedestals or bearing blocks 8 and 9 on the sides of the machine. A roller 10 is located in the area between the pedestals 8 and 9, the roller 10 being mounted on the ram 7. The end of the ram which extends above the pedestal 9 carries the clamped-on abutment arm 11, the free end of which is provided with the support roller 12.

Underneath the roller 10, a slide or carriage 13 is slidably arranged on the ram 7. The carriage 13 is biased by the tension spring 14 in the upward direction, the spring originating from the lowr side of the pedestal 9. The movement of the carriage 13 in the upward direction is limited by abutment by means of the head 15 of the screw 16, the latter extending from the lower pedestal 8. Leaf springs 17 are arranged on both sides of the carriage 13, the leaf springs 17 carrying the tong jaws or clamping fingers 18 on their ends.

The pedestal 8 furthermore is the carrier of the screw 19, the head 20 of which limits the downward displacement of the carriage 13, which carriage 13 is carried along by the upper tool 21. The downward displacement of the carriage 13 results in the upper tool 21 stepping against the inner flanks of the clamping fingers or jaws 18.

The working stroke of the ram 7 is achieved by means of the fork-shaped wedge 22. On the lower side the two legs of the fork form two inclined surfaces 23, 24 which are connected to one another such that the steeper inclined surface 23 lies in the range of the point or peak of the wedge. The upper side of the leg of the fork, which upper side lies opposite to these inclined surfaces, serves as a support plane 25. The latter steps against the abutment 26 on the machine side, which abutment is formed as a roller body. The steeper inclined surface 23 to the contrary is located in a contacting or engagement position on the roller 10 in the normal or starting position of the drive.

The piston rod 27 of the pneumatic cylinder 28 acts on and engages the wedge 22, the pneumatic cylinder receiving its support by the pedestal 29 on the side of the machine.

The support roller 12 of the abutment arm 11 is acted on by the angle lever 31, the latter swinging about the stationary bolt 30. The return spring 32 of the ram acts on the angle lever 31. The angle lever 31 with the coupling rod 33 which extends from the latter form the transmission connecting rod for the workpiece insertion or feed-in sliders 34 and 35,—see FIG. 5. The workpiece insertion slider 34 brings the upper parts 36 to the clapming fingers 18, while the workpiece insertion slider 35 which is located thereunder, shifts the lower parts 37 toward the lower tool 6.The upper parts 36 and lower parts 37 for example are the upper and lower parts of a rivet before they are assembled together. For this purpose the upper workpiece insertion slider 34 projects into a longitudinal recess 38 of the guide rail or ledge 39, the latter receiving the upper part 36, the ledge 39 extending up to the clamping fingers 18. The workpiece insertion slider 34 is rigidly connected with the carrier or driver 40, with the transverse carrier 41 and with the rail 42. The rail 42 is equipped on the end which points toward the clamping fingers 18 with the actuation finger 43. A tension spring 44 connected between the rail 42 and support 51 acts on the rail 42, which tension spring biases the rail 42 and consequently also the workpiece insertion slide 34 in the direction of the clamping fingers. The driver pin 45 extends from the rail 42, which pin 45 is supported on the rear surface of the guide block 46, the latter being connected with the coupling rod 33.

The lower workpiece insertion slider 35 also has a carrier or driver 47, the latter being rigidly connected with the rail 49 by means of the transverse carrier 48. Likewise a tension spring 44 acts on this rail 49, which tension spring spring biases the rail in the direction of the lower tool 6. Moreover this rail 49 also carries an abutment pin 45, the latter stepping against the rear surface of the guide 46. The front end of the rail 49 is equipped with the actuation finger 50. By means of the actuation fingers 43, 50, consequently it is possible to shift back the rails 42 and 49, respectively, out from the position according to Fig. 2, independent of the transmission connection rod 3l, 33 this being called a "free floating" connection between the insertion sliders and the connection rod drive.

The guide ledge 39 is carried by the supports 51 and 52 of the arm 5.

For the lower workpiece lead-in insertion slider 35, likewise a guide ledge 53 is provided, which guide ledge receives the lower part 37. The upper and lower parts are supplied to the guide ledges 39, 53 via the feed rails 54 and 55. The feed rail 54 serves for transporting the upper parts 36, the latter being provided with a pin 36', whereas the feed rail 55 carries the lower parts 37.

The two guide rails 54, 55 stand in connection with the storage chambers 56, 57, the latter being arranged one above the other in the form of floors. A single slider 59 which is moveable up and down is coordinated to both of the chambers 56, 57 in front of the inclined aligned rear wall 58.

The slider comprises three layers 60, 61 and 62 which are rigidly connected to one another. The slider 59 is equipped on its forward wide surface with stroke- and sorting ledges 64 and 65 which are inclined sloping downwardly in the direction of the one side wall 63. In particular the lift- and sorting ledge 64 is formed from the free upper end of the layer 61. The ledge 64 is made such that the lower parts 37 which are located in the storage chamber 56 load or lay-in according to FIG. 4. The other stroke- and sorting rail or ledge 65 extends on the upper end of the layer 62 and serves for reception of the upper parts 36, the latter being provided with the pin 36'.

The piston rod 66 of the pneumatic cylinder 67 acts on the layer 62. The stroke of the piston rod 66 is chosen so large that in the upper position of the slider, compare FIG. 3, the delivery-sided end of the sorting ledges 64, 65 is flush in alignment with the discharge openings 68 and 69, respectively, of the side wall 63. The discharge openings 68, 69 are adjusted to the shape of the upper parts and lower parts. Moreover the discharge openings 68 and 69 are arranged such that the feed rails 54 and 55, respectively, the latter originating from the discharge openings, receive the parts in perpendicular rolling position. The discharge openings 68, 69 are preferably located in exchangeable profile pieces 70 and 71, respectively, of the side wall 63.

As FIG. 4 shows, the stroke and sorting ledges 64, 65 are plunged or penetrate into the floor or bottom 72 and 73, respectively, of the storage chamber 56 and 57, respectively, in the lower reversing position of the slider movement, in order to guarantee a discharge without leaving any remainder.

The lower storage chamber 57 is open toward the top by means of a filling shaft 74, the latter leading in front of the upper storage chamber 56.

In the upper position of the slider 59 the upper parts 36 arrive in front of the discharge opening 69 in the side wall 63. From there the upper parts 36 roll in the downwardly sloping section 54' of the feed rail 54. However a turn of the upper parts 36 is required such that the upper part is fed to the tongs such that the pin 36' thereof projects downwardly. For this purpose on the transfer position between the inclined downwardly sloping section 54' and the vertical section 54'' there is provided a turn position 75, the latter being equipped with a helical-shaped track guide.

The following manner of operation occurs. Starting from the position according to FIG. 2, the workpiece insertion sliders 34, 35 already have placed an upper part and a lower part into the clamping fingers 18 and the lower tool 6, respectively. Subsequently the hydraulic cylinder 28 steps into action after pressing down the foot lever 3. The steeper inclined surface 23 acts on or engages the roller 10 of the ram 7 and displaces the ram 7 in the downward direction, and indeed in the quick stroke. By means of the upper tool 21, which is applied or inserted on the lower end of the ram 7, the clamping fingers 18 and consequently the slide 13 are moved therewith. The displacement of the slide 13 is limited when it abuts or sits on the head 20 of the screw 19. The wedge 22 however displaces the ram 7 further downwardly. By means of the upper tool 21, the clamping fingers 18 are spread apart from one another. The actual connecting operation of the upper part and lower part 36, 37 now starts. During this connection phase the less inclined sloping surface 24 of the wedge 22 operates.

Simultaneously with the downward displacement of the ram 7, the support roller 12 moves the transmission connection rods 31, 33 in the position according to FIG. 3. By means of the abutment pins 45 the glide block 46 has shifted the rails 42, 49 and consequently the workpiece introduction sliders 34 and 35, respectively, back, so that, respectively, each one upper part and lower part, respectively, can enter the guide ledges 39 and 53, respectively.

Simultaneously with the return stroke of the wedge 22, by means of the tension spring 32, the transmission connection rods 31, 32 and also the ram 7 arrive back into their starting position according to FIG. 2, whereby by means of the workpiece introduction sliders 34, 35, the latter being moved forwardly by the tension springs 44, one upper part and lower part 36, 37 each is placed into the tongs 18 and the lower tool 6, respectively. During this working period the slider 59 moves upwardly and downwardly and by means of the stroke- and sorting- ledges 64, 65, brings the upper- and lower- parts 36, 37 in front of the discharge openings 68, 69, respectively, of the side wall 63.

I claim:

1. A machine for attachment of workpieces particulary to clothing pieces, with an upper tool traveling towards a lower tool, comprising a machine housing, an upper tool ram being vertically guidably mounted in said machine housing to be able to perform a working stroke, an upper tool being mounted on said ram, a lower tool operatively cooperating with said upper tool, a wedge being formed with an inclined surface, a roller mounted on said ram, an abutment operatively mounted to said machine housing, and means for moving said wedge between said roller and said abutment, with said inclined surface running on said roller of the ram, whereby said working stroke of said ram being achieved by said inclined surface of said wedge running on said roller with said wedge stepping between said roller and said abutment, means constituting spring-biased workpiece insertion sliders for sliding upper and lower of the workpieces in a forward movement into a working position between said upper and lower tools, said sliders extending from said upper tool and lower tool, respectively, and transversely directed relative to said ram, means for translating a downward movement of said ram into a rearward movement of said sliders away from said tools, storage means for storing the workpieces, means comprising feed rails for bringing the workpieces from said storage means to said sliders, spring means for forwardly moving said sliders when said ram is moved upwardly with their forward movement dependent on spring force, whereby said sliders move the workpieces forwardly into the working position.

2. The machine according to claim 1, wherein said translating means comprises connecting rod means for transmitting the downward movement of the ram to said sliders for moving the latter rearwardly, said sliders are operatively releaseably connected to said connecting rod means and moveable rearwardly independently of said connecting rod means, sideways-directed actuation fingers mounted on said sliders.

3. The machine according to claim 1, further comprising a slide mounted on said ram, leaf springs disposed on both sides of said ram and extending from said slide, and clamping fingers carried on said leaf springs, said clamping fingers disposed so as to be carried along by said upper tool during a downward stroke of said ram.

4. The machine according to claim 1, further comprising means for spring biasing said ram in a return movement direction away from the lower tool, a transmission connection rod moveably mounted in said housing and operatively connected to said ram, said spring biasing means constitutes a ram return spring connected to said transmission connection rod.

5. The machine according to claim 2, wherein said connecting rod means includes an angle lever pivotally mounted in said housing, an abutment arm including a roller engages said angle lever, said abutment arm is secured to said ram.

6. A machine for attachment of workpieces particularly to clothing pieces, with an upper tool ram traveling towards lower tool, comprising a machine housing, an upper tool ram being substantially vertically guidably mounted in said machine housing to be able to perform a working stroke, an upper tool being mounted on said ram, a lower tool operatively cooperating with said upper tool, means for moving said upper tool ram downwardly to perform said working stroke of said ram, means constituting spring-biased workpiece insertion sliders for sliding upper and lower of the workpieces in a forward movement into a working position between said upper and lower tools, said sliders extending from the upper tool and lower tool, respectively, and transversely directed relative to said ram, means for translating a downward movement of said ram into a rearward movement of said sliders away from said tools, storage means for storing the workpieces, means comprising feed rails for brining the workpieces from said storage means to said sliders, spring means for forwardly moving said sliders when said ram is moved upwardly with their forward movement dependent on spring force, whereby said sliders move the workpieces forwardly into the working position.

7. The machine according to claim 6, further comprising means for spring biasing said ram in a return movement direction away from the lower tool, a transmission connection rod moveably mounted in said housing and operatively connected to said ram, said spring biasing means constitutes a ram return spring connected to said transmission connection rod.

8. The machine according to claim 6, wherein, said translating means comprises connecting rod means for transmitting the downward movement of the ram to said sliders for moving the latter rearwardly, said sliders are operatively releaseably connected to said connecting rod means and moveable rearwardly independently of said connecting rod means, sideways-directed actuation fingers mounted on said sliders.

9. The machine according to claim 8, wherein said connecting rod means includes an angle lever pivotally mounted in said housing, an abutment arm including a roller engages said angle lever, said abutment arm is secured to said ram.

* * * * *